US012172065B2

(12) United States Patent
Ramirez

(10) Patent No.: US 12,172,065 B2
(45) Date of Patent: Dec. 24, 2024

(54) AQUATIC STRENGTHENING DEVICE

(71) Applicant: Paul Ramirez, Mission, TX (US)

(72) Inventor: Paul Ramirez, Mission, TX (US)

(73) Assignee: Paul Ramirez, Mission, TX (US)

( * ) Notice: Subject to any disclaimer, the term of this patent is extended or adjusted under 35 U.S.C. 154(b) by 52 days.

(21) Appl. No.: 17/803,179

(22) Filed: Apr. 21, 2021

(65) Prior Publication Data

US 2024/0009539 A1 Jan. 11, 2024

(51) Int. Cl.
*A63B 69/14* (2006.01)

(52) U.S. Cl.
CPC ..... *A63B 69/14* (2013.01)

(58) Field of Classification Search
CPC ..... A63B 69/00; A63B 69/12; A63B 69/14
USPC ..... 441/129, 65, 74, 80
See application file for complete search history.

(56) References Cited

U.S. PATENT DOCUMENTS 2,709,266 A * 5/1955 Munn ..... B63B 34/63 434/254
4,518,364 A * 5/1985 Jacobson ..... A63B 69/14 434/254

* cited by examiner

*Primary Examiner* — Daniel V Venne
(74) *Attorney, Agent, or Firm* — LEAVITT & ELDREDGE, LLC; Richard Eldredge

(57) ABSTRACT

The present invention relates to an aquatic strengthening device which comprises of a rigid or semi rigid elongated board and at each end a floating device is attached. The elongated board is sufficiently strong to permit an individual to stand on it. The floating devices have enough buoyancy that allows for the elongated board to float up to a desired altitude. There are openings next to where the floating devices are so an individual can hold the elongated board with his hands. The floating devices are attached in such a way that the perpendicular distance to the rigid elongated board can be changed so an individual can obtain the buoyancy needed.

8 Claims, 6 Drawing Sheets

AQUATIC STRENGTHENING DEVICE

BACKGROUND OF INVENTION

Elongated float, kickboards with floats, aquatic swimming aids, are part of the known art. For example, U.S. Pat. No. 4,227,273 and Chinese patent 210904889 show floating devices. However, the inventor is not aware of any devices that specifically target strength-building therapy. Particularly the inventor is not aware of any devices that specifically use the buoyancy effect of water to help an individual regain its strength and balance at the same time. There are no devices known to the inventor that gives the user the ability to increase or decrease the buoyancy effect of the water in such a way that recovery from an injury can be obtained. This particular invention specifically addresses that issue. It also has other advantages. As for entertainment and training for particular swimming techniques. If this device is used properly, it will increase an individual's flexibility, strength, elasticity, and in some instances proper swimming techniques.

SUMMARY OF INVENTION

As it's illustrated here, this aquatic strengthening device is the sign of a rigid or semi-rigid structure with floats spaced at each end of the structure. This structure which is elongated by nature it has enough rigidity to withstand stress without bending and also to permit the weight of an individual on top of it without bending. The device can be made from a wide range of materials. Organic or not organic such as wood, high density wood, plastic, submergible conglomerate or other materials that will allow to accomplish the necessary rigidity while being waterproof. The structure has to be long enough to permit a swimmer to stand on it. It also needs to have devices so it can be handheld. The float can be made of any material that will float in the water. It is important to note that the upper half of the floats need to be above water to establish the desired results. The floats can be of styrofoam, plastic filled with air, or any other material that can be a sphere. These floats are then attached to the structure in such a way that they'll stand perpendicularly at a desired length. This length can be adjusted according to an individual's necessity. This invention will be described in greater detail in the next two sections.

DETAILED DESCRIPTION OF THE DRAWINGS

Figure 1:
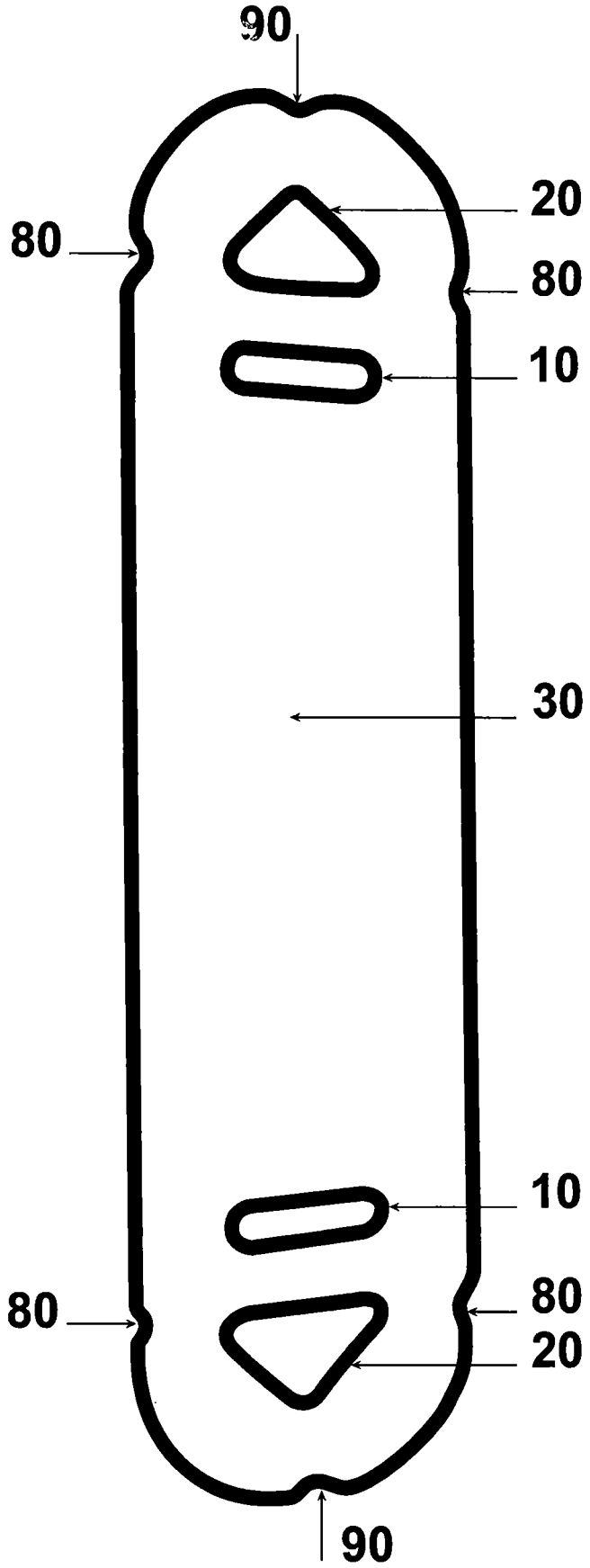
FIG. 1 is a top or bird eye view of the structure or elongated board.
Figure 2:
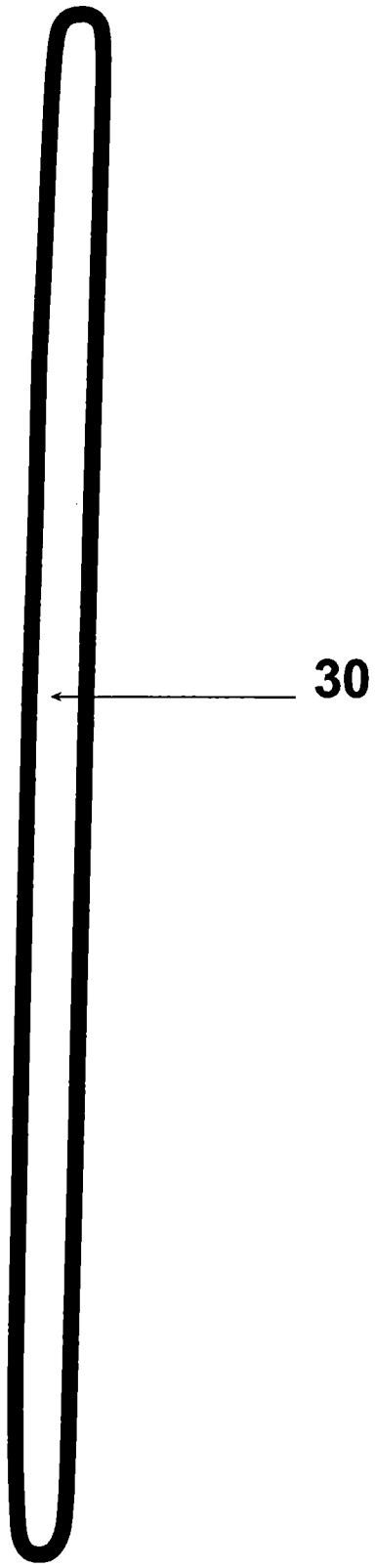
FIG. 2 is a side view of structure or elongated board.
Figure 3:
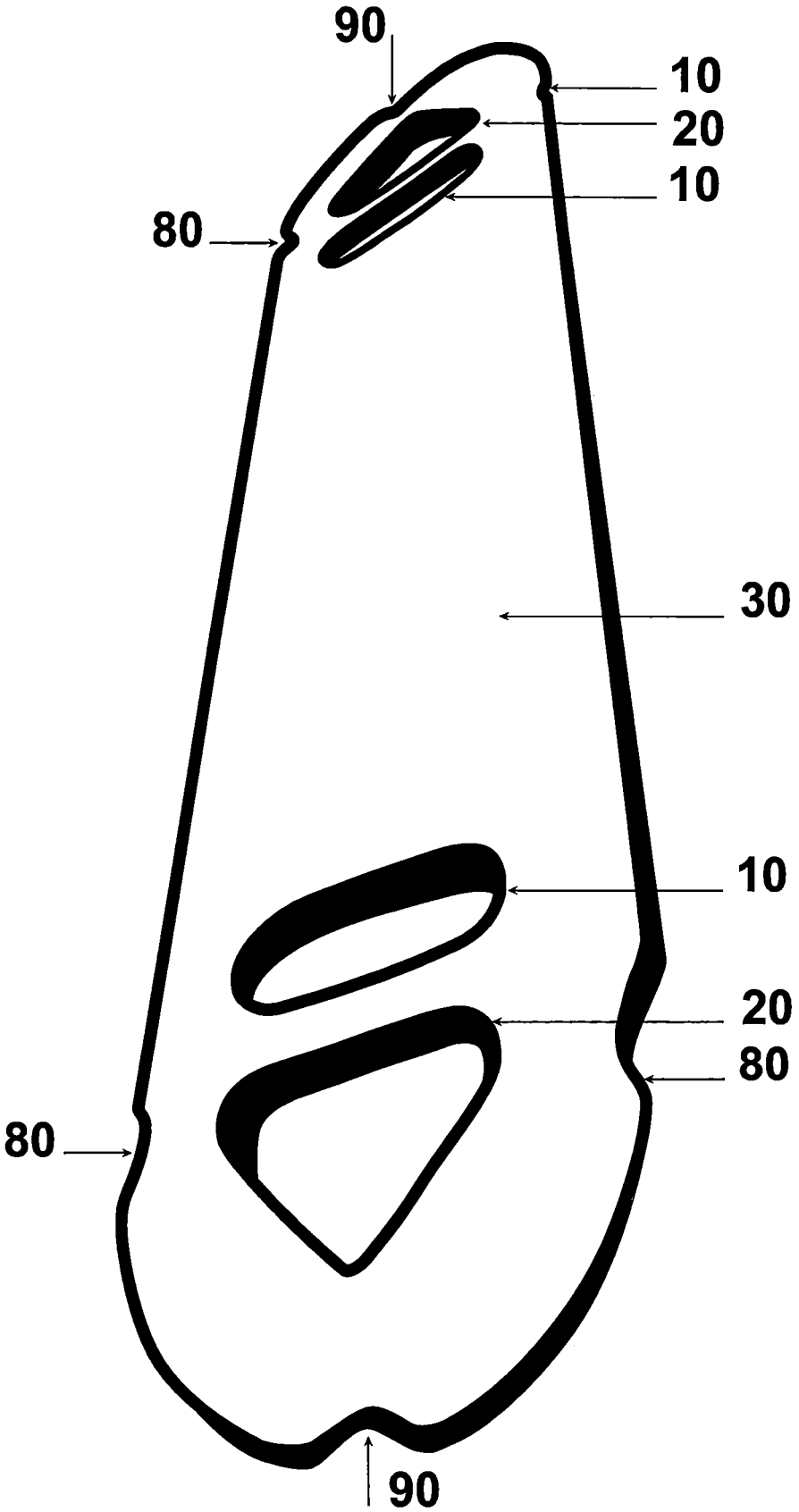
FIG. 3 is a perspective view of the structure or elongated board.

The following is a detailed description of the inventors preferred way to practice this invention. Looking at the drawings 1 to 3 aquatic strengthening device 30 compromises open aperture 20 to hold the floating device and a handheld opening 10 so the user can maneuver while using the floating device. The aquatic strengthening device 30 can be made all way high density wood, carbon fiber, plastic or any other material with the proper flexibility and rigidity in order to hold an individual's weight. It is expected that the proper length of the aquatic strengthening device 30 will be anywhere from 24 inches to 48 inches. It can also be noted depth the handheld opening 10 can be an individual opening or a plurality of openings. This will depend on the user's desire. This device has a pair of side grooves 80 located exactly perpendicular to open aperture 20. These side grooves 80 are located at each end of the aquatic strengthening device 30 at the same place that the open aperture 20 is. It also has an extreme side groove 90 on each of the sides of the aquatic strengthening device 30. The open aperture 20 should be in the triangular form. The reason for this triangle of form is that when the floater holders 60 are attached to the aquatic strengthening device 30 give some rigidity so the floating devices 50 does not move.

Figure 4:
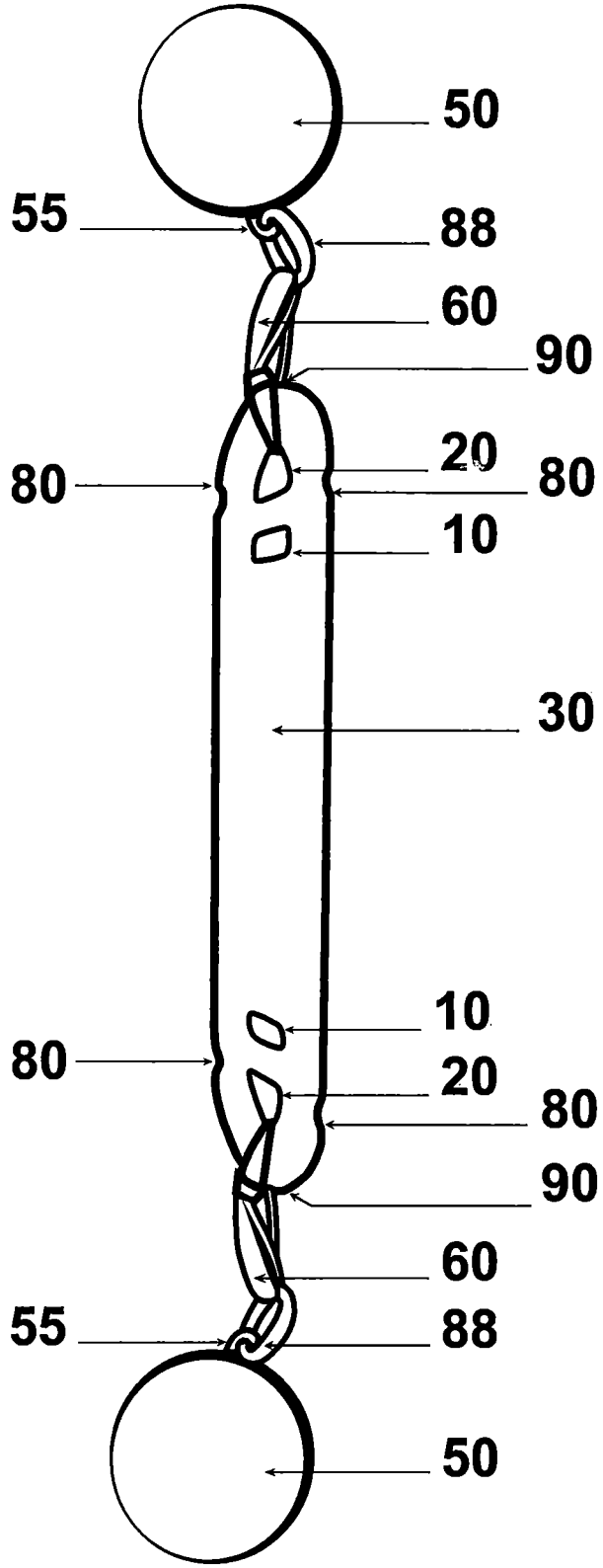
FIG. 4 is a perspective view of the invention.
Figure 5:
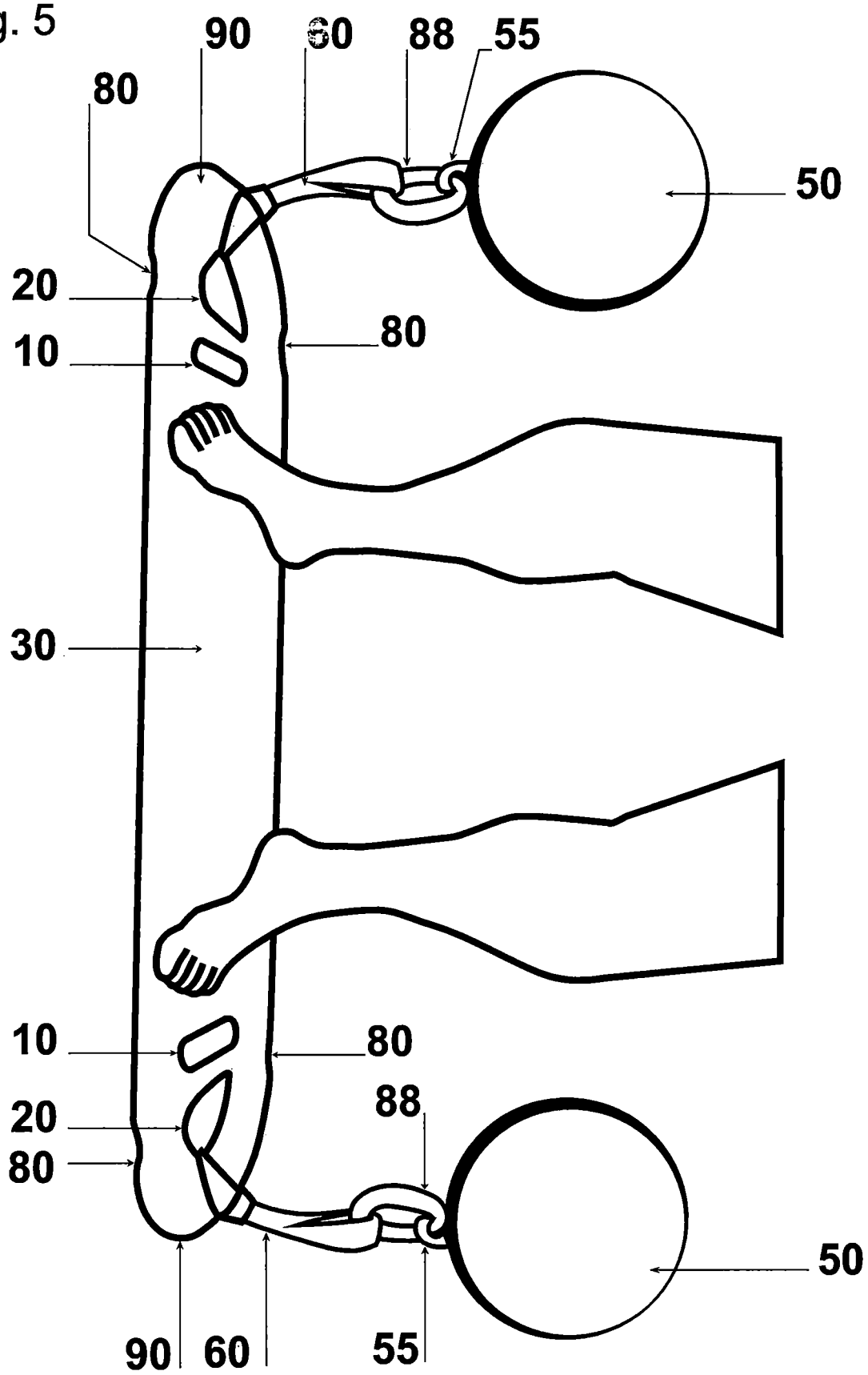
FIG. 5 is a perspective view of the invention in use under water.

Referring to FIGS. 4 and 5 they show the complete invention. The floating devices 50 are attached to the open aperture 20 through the use of holding wires 60. These holding wires 60 may or may not have an additional height adjustment 88 as part of the setup. The floating device is 50 can be of styrofoam, they can be rectangular, or they can be spherical. It can also be of any floating structure such as milk jugs. The only requirement is to provide the necessary buoyancy force. And anyways the floating device 50 has an opening 55 to attach the holding wire 60. The floating device 50 can be styrofoam blocks 20" long, 16" wide and 13" deep. In the event the floating device 50 is a sphere then de overall sphere diameter can be in the neighborhood of 6" to 12". The size and characteristics of floating device 50 will depend on the specific characteristics of the individual using the aquatic strengthening device 30.

Specifically, FIG. 5 shows the preferred embodiment of the invention. Floating devices 50 are attached to the aquatic strengthening device 30 via holding wire 60. The holding wires 60, are attached to the aperture 20 through either the side groove 80 or side groove 90. The holding wire 60 has a height adjustment 88. This height adjustment can be made out of a velcro material, a link chain or any other submersible material. The objective of the height adjustment 88 is to be able to adjust the floating altitude off floating device 50.

Figure 6:
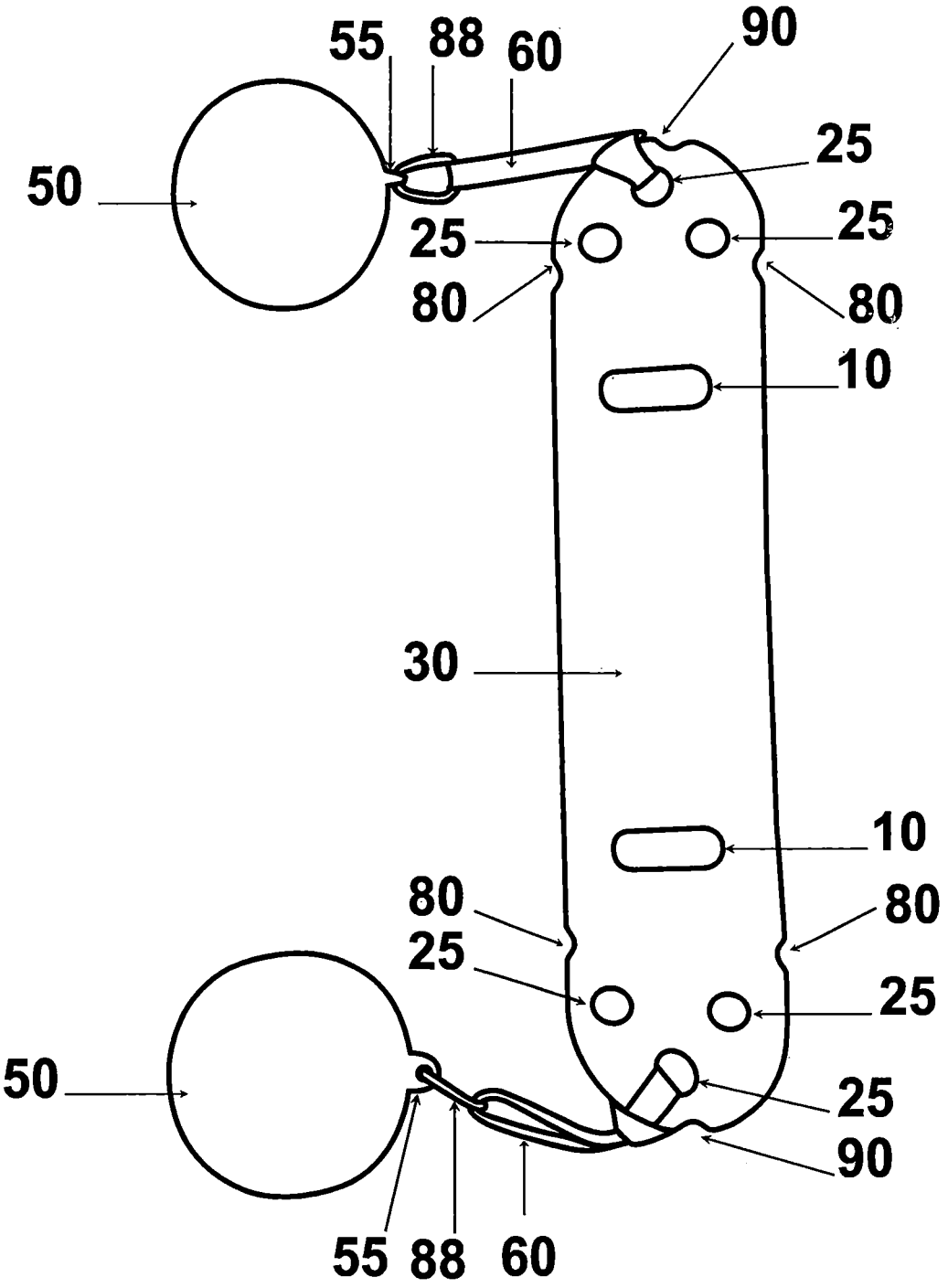
FIG. 6 is a different embodiment of the present invention.

As stated earlier there can be different embodiments of the present invention. FIG. 6 where open aperture 20 is changed for a series of stabilizing holes 25.

It is implied in this application that the structure of this invention can be adapted for an individual's particular needs. These needs depend on an individuals' particular goals.

Note that the disclosure is for the purpose of illustration only and includes all modifications or improvements which fall within the scope of the proposed claims.

I claim:

1. An aquatic strengthening device, comprising:

a) an elongated board;

b) a pair of open apertures;

c) a pair of handheld openings;

d) a plurality of side grooves;

e) a pair of holding wires; and f) a pair of floating devices wherein said pair of open apertures are located at opposite ends of said elongated board, said pair of handheld openings are located next to said open apertures, the plurality of side grooves are located at an edge of said elongated board next to said handheld openings, said holding wires are attached at one end with said elongated board through said open apertures and attached on the opposite ends with said floating devices.

2. The aquatic strengthening device of claim 1 further comprising a height adjustment to said holding wire.

3. The aquatic strengthening device of claim 1 wherein the floating devices are spherical.

4. The aquatic strengthening device of claim 1 wherein the floating devices are a plurality of devices.

5. An aquatic strengthening device comprising:

a) an elongated board;

b) a plurality of stabilizing holes;

c) a pair of handheld openings;

d) a plurality of side grooves;

e) a pair of holding wires; and f) a pair of floating devices wherein a pair of open apertures are located at opposite ends of said elongated board, said pair of handheld openings are located next to said open apertures, the plurality of side grooves are located at an edge of said elongated board next to said handheld openings, said holding wires are attached at one end with said elongated board through said open apertures and attached on the opposite ends with said floating devices.

6. The aquatic strengthening device of claim 5 further comprising a height adjustment to said holding wire.

7. The aquatic strengthening device of claim 5 wherein the floating devices are spherical.

8. The aquatic strengthening device of claim 7 wherein the said floating devices are a plurality of devices.

* * * * *